US010502450B2

(12) United States Patent
Holland et al.

(10) Patent No.: US 10,502,450 B2
(45) Date of Patent: Dec. 10, 2019

(54) INSULATED COVER FOR WHOLE-HOUSE FAN

(71) Applicant: Air Vent, Inc., Dallas, TX (US)

(72) Inventors: Robert B. Holland, Rowlett, TX (US); Grayson M. Griffin, Grand Prairie, TX (US)

(73) Assignee: AIR VENT, INC., Dallas, TX (US)

( * ) Notice: Subject to any disclaimer, the term of this patent is extended or adjusted under 35 U.S.C. 154(b) by 365 days.

(21) Appl. No.: 15/384,890

(22) Filed: Dec. 20, 2016

(65) Prior Publication Data

US 2017/0198940 A1 Jul. 13, 2017

Related U.S. Application Data

(60) Provisional application No. 62/276,556, filed on Jan. 8, 2016.

(51) Int. Cl.

| | |
|---|---|
| ***F24F 13/20*** | (2006.01) |
| ***F04D 29/52*** | (2006.01) |
| ***F04D 29/32*** | (2006.01) |
| ***F24F 7/013*** | (2006.01) |

(52) U.S. Cl.

CPC ..... *F24F 13/20* (2013.01); *F04D 29/325* (2013.01); *F04D 29/522* (2013.01); *F24F 7/013* (2013.01); *F24F 2013/205* (2013.01); *F24F 2221/14* (2013.01)

(58) Field of Classification Search

CPC ..... F24F 13/20; F24F 13/205; F24F 2221/14; F24F 7/013; F04D 29/325; F04D 29/522

USPC ..... 454/347

See application file for complete search history.

(56) References Cited

U.S. PATENT DOCUMENTS

| | | | | |
|---|---|---|---|---|
| 3,587,745 | A * | 6/1971 | Perry | A62C 3/0207 169/15 |
| 3,653,431 | A * | 4/1972 | Loveley | F24F 3/00 165/137 |
| D275,988 | S | 10/1984 | Walker | |
| 4,709,624 | A * | 12/1987 | Croft | F24F 7/025 156/291 |
| D296,584 | S | 7/1988 | Hilton | |
| D325,431 | S | 4/1992 | Novobilski | |
| 6,527,422 | B1 | 3/2003 | Hutchison | |
| D543,652 | S | 5/2007 | Hargreaves | |
| D544,985 | S | 6/2007 | Hargreaves | |
| 7,731,477 | B2 * | 6/2010 | Erni | F24F 7/025 415/126 |
| D634,060 | S | 3/2011 | Wardenburg | |

(Continued)

OTHER PUBLICATIONS

USPTO Office Action issued in U.S. Appl. No. 29/588,488, dated Jun. 21, 2018, pp. 1-12.

(Continued)

*Primary Examiner* — Steven B McAllister
*Assistant Examiner* — Allen R Schult
(74) *Attorney, Agent, or Firm* — Duane Morris LLP

(57) ABSTRACT

An insulated cover for a whole-house fan includes a base defining an opening for disposal over the whole-house fan, and first and second, oppositely disposed, ceiling doors each hingedly connected to the base. In a closed configuration the ceiling doors each sit at an acute angle with respect to a horizontal plane corresponding with a bottom surface of the base. The base and ceiling doors are formed from thermal insulation board.

22 Claims, 12 Drawing Sheets

(56) References Cited

U.S. PATENT DOCUMENTS

| | | | | |
|---|---|---|---|---|
| D637,162 | S | 5/2011 | Bridgman | |
| D698,986 | S | 2/2014 | Reynolds | |
| D736,450 | S | 8/2015 | Reynolds | |
| D739,595 | S | 9/2015 | Reynolds | |
| D745,993 | S | 12/2015 | Reynolds | |
| D748,849 | S | 2/2016 | Stanley | |
| D748,850 | S | 2/2016 | Johnson | |
| D771,793 | S | 11/2016 | Smith | |
| D779,650 | S | 2/2017 | Poehlman | |
| D802,831 | S | 11/2017 | Reynolds | |
| 2002/0191376 | A1* | 12/2002 | Ota | H05K 7/20581 361/695 |
| 2007/0011930 | A1* | 1/2007 | Yarmosh | A47G 5/00 40/725 |
| 2009/0262540 | A1 | 10/2009 | Hargreaves | |
| 2012/0149294 | A1* | 6/2012 | Labrecque | A01K 1/0052 454/353 |

OTHER PUBLICATIONS

Screen shots from https://www.youtube.com/watch?v=dkUzRp-pGpgg, published on Mar. 11, 2013 (accessed on Jan. 25, 2017).
Screen shots from https://www.youtube.com/watch?v=c3cN0kPqGQI, published on Apr. 9, 2012 (accessed on Jan. 25, 2017).
Screen shots from https://www.youtube.com/watch?v=XQriYz5OUZw, published on Nov. 1, 2013 (accessed on Jan. 25, 2017).

* cited by examiner

INSULATED COVER FOR WHOLE-HOUSE FAN

CROSS REFERENCE TO RELATED APPLICATIONS

This application claims priority to U.S. Provisional Patent Application Ser. No. 62/276,556 filed Jan. 8, 2016, the entirety of which is incorporated herein by reference.

FIELD OF THE INVENTION

The present invention relates to insulated covers for whole-house fans.

BACKGROUND OF THE INVENTION

Whole-house fans, which are typically installed in an attic over an opening in a ceiling, are an effective alternative to traditional (refrigerated) air conditioning, especially in regions with mild climates. The whole-house fan vents air from a structure's occupied space into the structure's attic and is designed to circulate air in a home or building. Specifically, the fan pulls air out of a building and forces it into the attic space. A positive pressure differential is created in the attic that forces air out through the gable and/or soffit vents, while at the same time producing a negative pressure differential inside the living areas that draws air in through open windows or doors. While effective, during the winter months warm air can leak into the attic from the living space through the whole-house fan shutters. Likewise, in warm months, warm air from the attic can leak into the living space through the whole-house fan shutters when the fan is not operational.

SUMMARY OF THE INVENTION

In embodiments, an insulated cover for a whole-house fan includes a base defining an opening for disposal over the whole-house fan, and first and second, oppositely disposed, ceiling doors each hingedly connected to the base. In a closed configuration the ceiling doors each sit at an acute angle with respect to a horizontal plane corresponding with a bottom surface of the base. The base and ceiling doors are formed from thermal insulation board.

In embodiments, a kit for use in assembling an insulated cover for a whole-house fan, includes first and second thermal insulation board ceiling doors; first and second thermal insulation board side walls; front and rear thermal insulation board walls; four lower hinged bracket components; four upper hinged bracket components; and four locking pins for coupling the upper hinged bracket components to the lower hinged bracket components.

In embodiments, a method of insulating a whole-house fan includes the steps of: providing an insulated cover, the insulated cover comprising: a base defining an opening for disposal over the whole-house fan; and first and second ceiling doors each hingedly connected to the base, wherein in a closed configuration the ceiling doors each sit at an acute angle with respect to a horizontal plane corresponding with a bottom surface of the base, wherein the base and ceiling doors are formed from thermal insulation board; and disposing the insulated cover over the whole-house fan, whereby the ceiling doors are forced open from the closed configuration to an open configuration by air flow from the whole-house fan when the whole house fan turns on and return to the closed configuration to form an insulated cover around the whole-house fan when the whole-house fan turns off.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
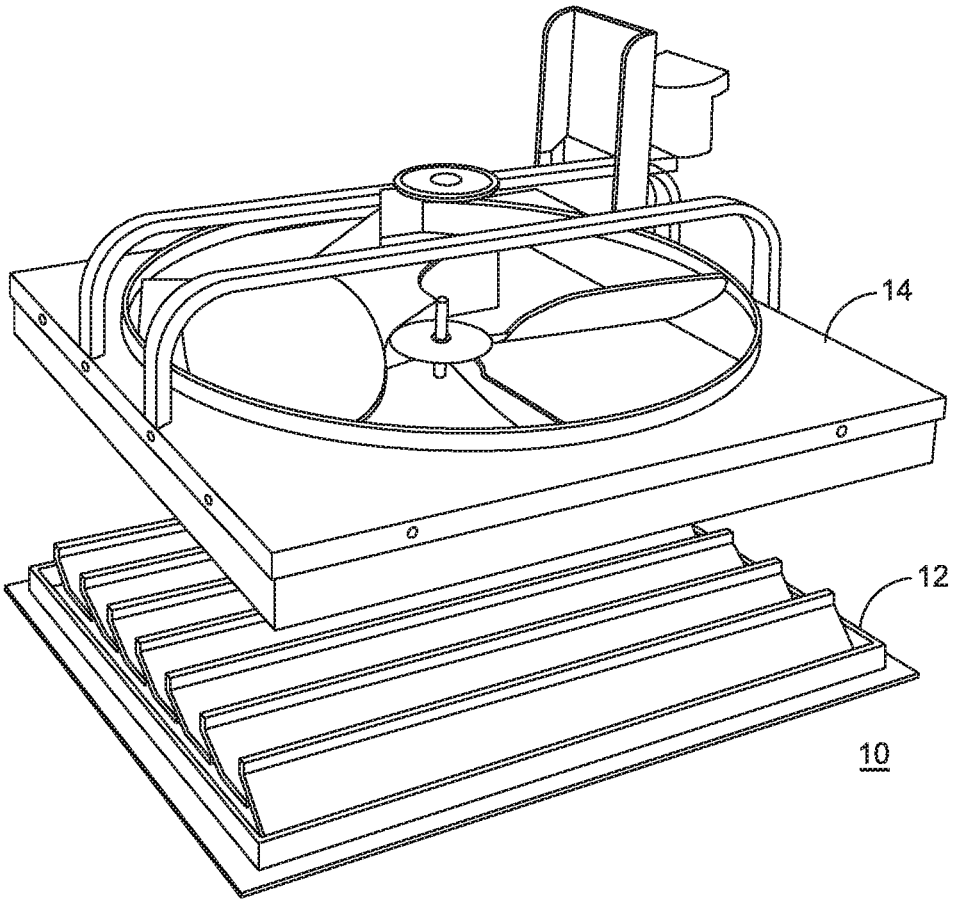
FIG. 1 illustrates a whole-house fan system for an attic.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 illustrates a whole-house fan system 10, such as the 30" or 36" belt-driven whole-house fan system available from Air Vent Inc. of Dallas, Tex. The whole-house fan system 10 includes a vent or shutters 12 that is disposed in an opening of the attic floor and a motorized fan assembly 14 sized to fit over the vent/shutters 12.

Described herein is an insulated cover for a whole-house fan, such as shown in FIG. 1, designed to insulate the whole-house fan system from the penetrating air and unwanted heat transfer. In embodiments the insulated cover is provided as a kit including pre-cut rigid foam insulation boards or panels that can be fitted together and dropped or slid over the fan's sides and motor, completely encompassing the fan and providing the necessary insulation barrier when the fan is not in use.

Figure 2:
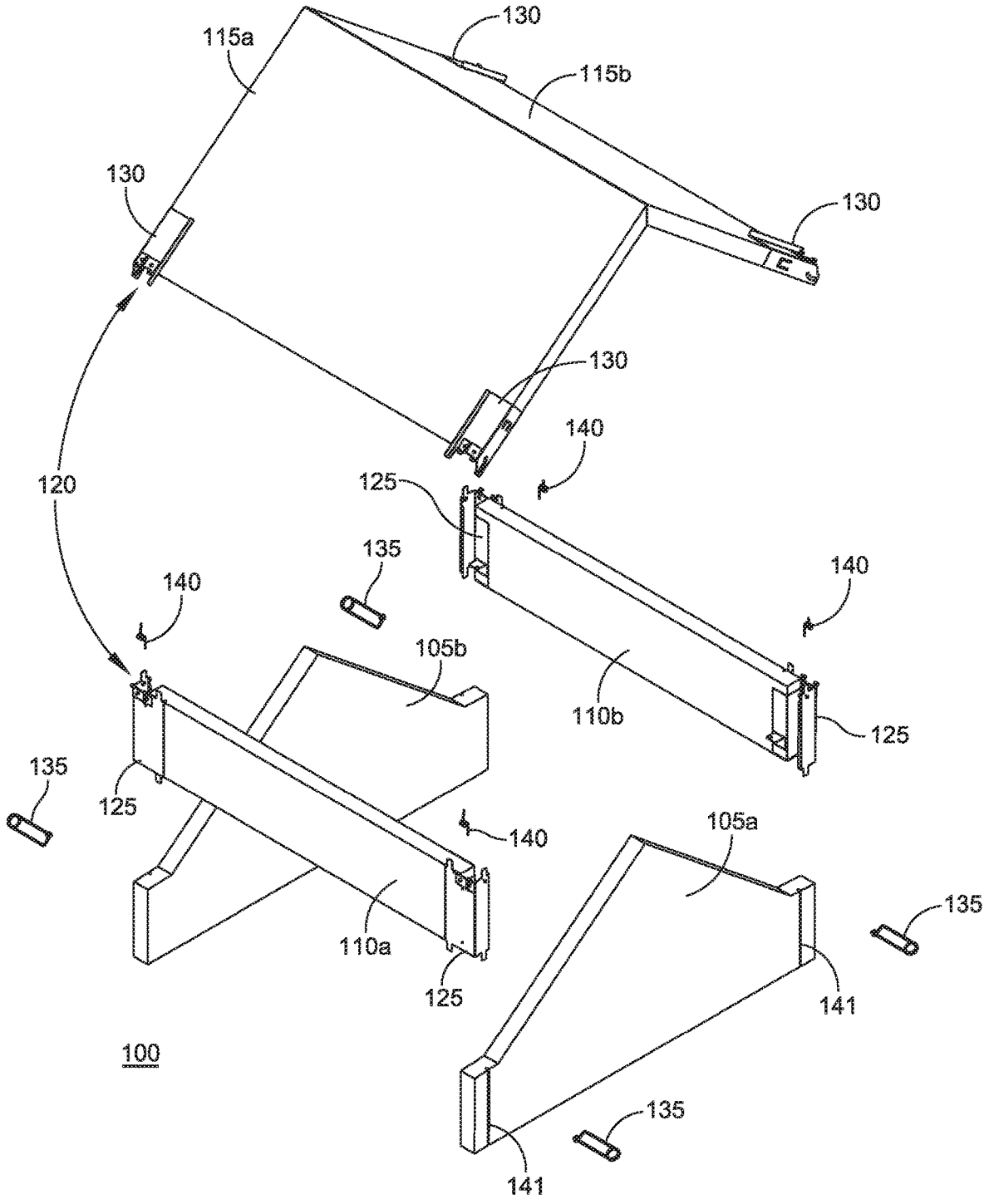
FIG. 2 illustrates the components of a kit for assembling an insulated cover for a whole-house fan according embodiments.
Figure 3:
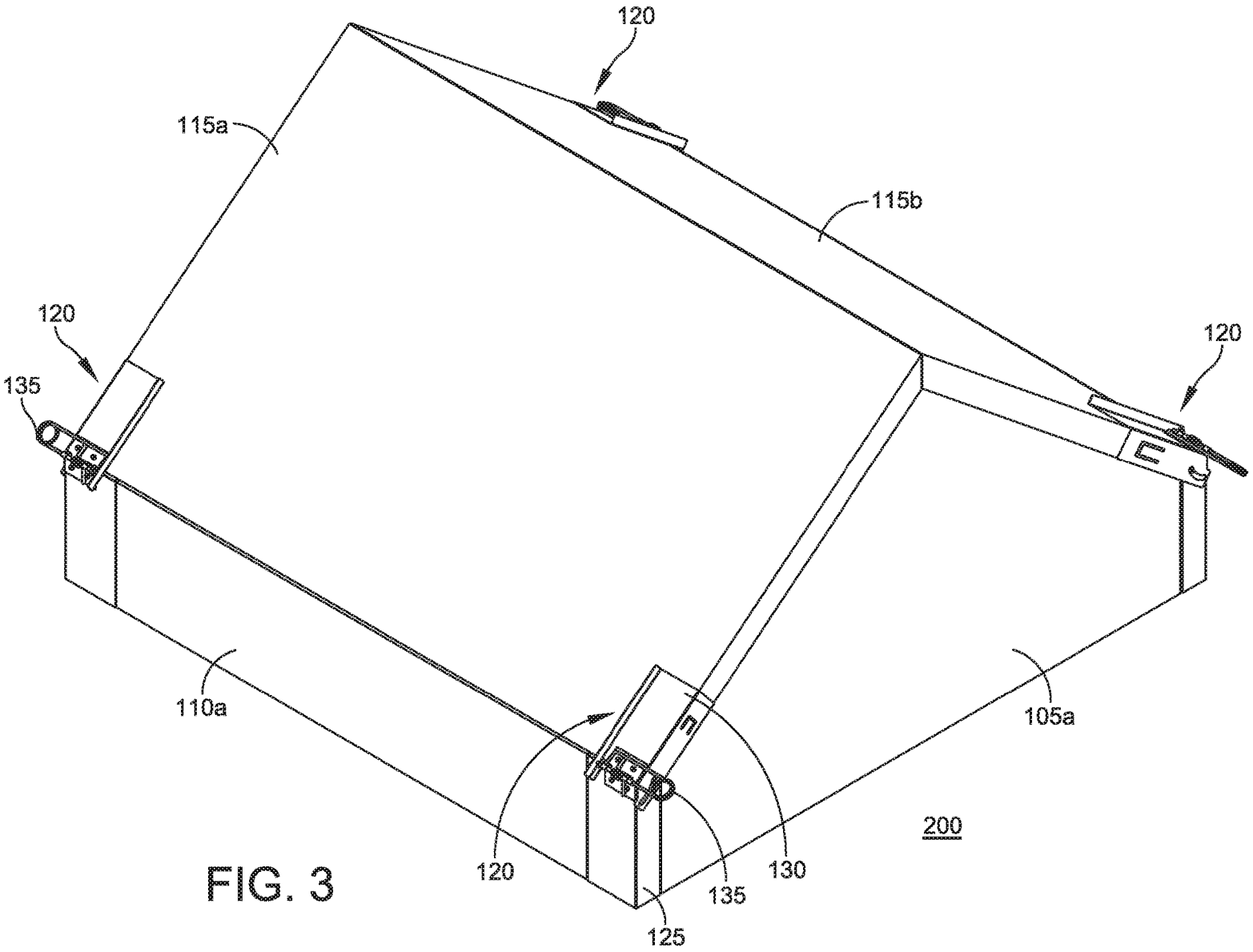
FIG. 3 is a perspective view of an assembled insulated cover for a whole-house fan in a closed configuration according embodiments.
Figure 4:
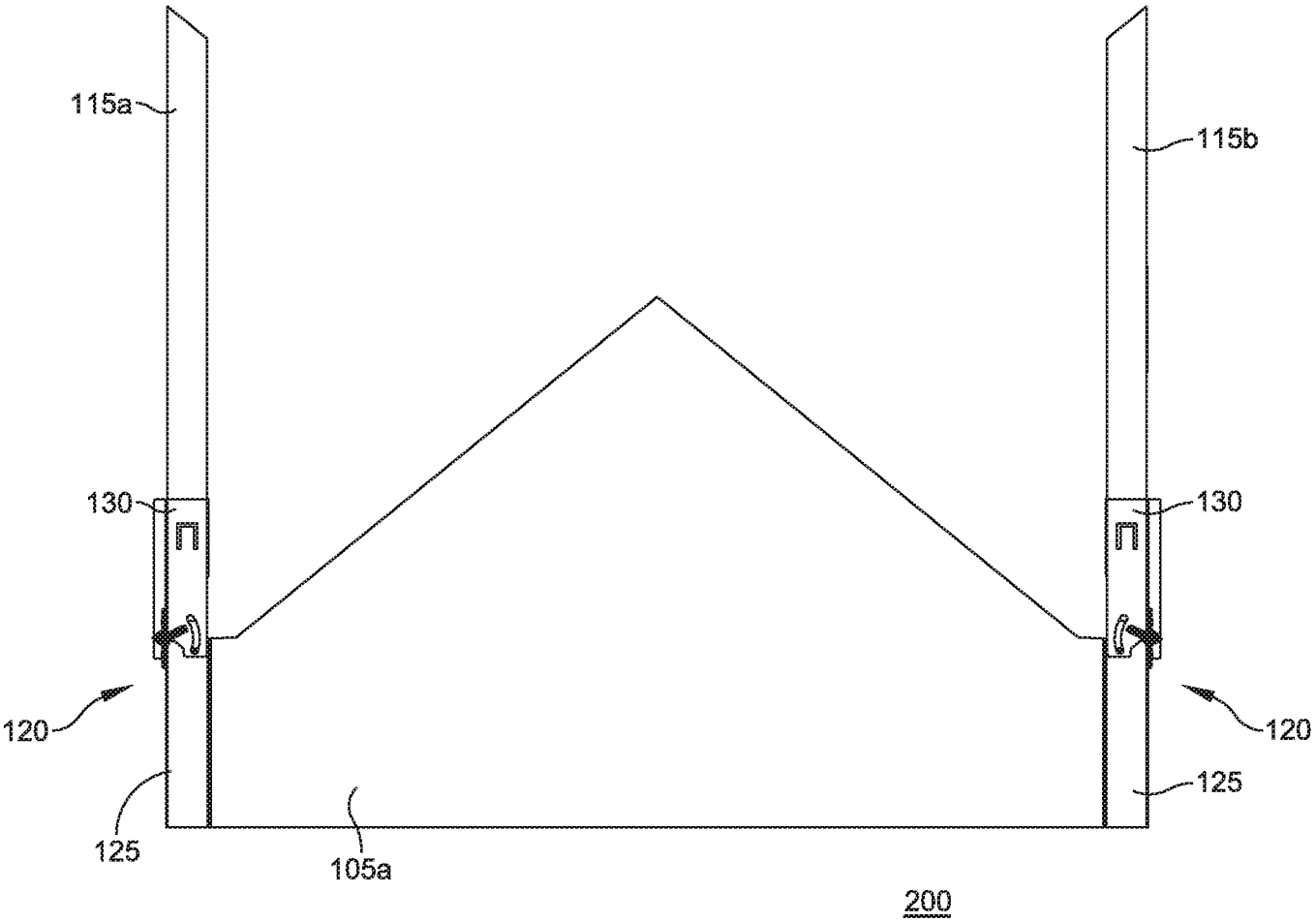
FIG. 4 is a side elevation view of the assembled insulated cover of FIG. 3 in the open configuration.

FIG. 2 illustrates an embodiment of a kit 100 for use in assembling an insulated cover for a whole-house fan 200 as shown in FIGS. 3 and 4. In the illustrated embodiment the kit 100 includes generally triangular shaped identical front and rear insulation board walls or panels 105*a*, 105*b*; identical rectangular side walls or panels 110*a*, 110*b*; and two identical insulated ceiling damper doors or panels 115*a*, 115*b*. The kit includes four hinged brackets 120, each having a respective locking pin 135 and, in embodiments, torsional spring 140 (i.e., for a total of four locking pins 135 and four torsional springs 140). In embodiments, each hinged bracket 120 includes a lower bracket component 125 and an upper bracket component 130 configured to mate with one another. The construction and assembly of the hinges is explained below in more detail in connection with FIGS. 5A to 7C. In embodiments, two of the lower bracket components 125 come preinstalled on opposite ends of rectangular side wall 110*a*, and two of the lower bracket components 125 come preinstalled on opposite ends of the rectangular side wall 110*b*. In embodiments, two of the upper components 130 come preinstalled at the lower left and right hand corners of one of ceiling door 115*a*, and two of the upper components 130 come preinstalled at the lower left and right hand corners of ceiling door 115*b*. As described below, one torsional spring 140 is inserted between each pair of lower and upper bracket components 125, 130 and the components are locked together by insertion of a locking pin 135. In embodiments, the lower and upper bracket components 125, 130 are not preinstalled but rather are provided loose as part of the kit 100 for later connection to the side walls 110 and ceiling doors 115 at the time of assembly. In embodiments, the one or more of the hinged brackets 120 are provided in the kit uninstalled (on the boards) but with the upper and lower components preassembled with the torsional springs 140 and locking pins 135 in place. In embodiments, the lower bracket component 125 is provided preinstalled on the walls 105 instead of the walls 110.

While FIG. 2 shows an embodiment with two identical insulated ceiling damper doors or panels 115*a*, 115*b*, it should be understood that in embodiments there could be more than two doors. For example, there could be four (or more) doors, with two (or more) doors on either side of the cover.

FIG. 3 is a perspective view of the assembled insulated cover for a whole-house fan 200, which can be assembled from the kit 100 illustrated in FIG. 2. FIG. 4 is a side elevation view illustrating the insulated cover 200 in the open configuration, such as when a covered whole-house fan is operational to pull air from the building space into the attic. As can be seen in FIGS. 3 and 4, the ceiling doors 115 are preferably sloped, i.e., angled with respect to the horizontal. In embodiments, these doors 115 are sloped with respect to the horizontal at an angle up to about 45°. In embodiments, the doors 115 are sloped at least about 15°, and in embodiments are sloped between about 35-40°. In other embodiments, the doors 115 are not sloped with respect to the horizontal (i.e., the angle is 0° with respect to the horizontal) as long as there is sufficient spacing between the doors and the fan. Providing sloped doors 115 reduces the distance that the doors must open when the fan cycles on, as well as reduces the distance the doors 115 must close, which reduces noise when the doors close (when compared to door(s) that are in the horizontal plane when at rest). Angling the ceiling doors also makes it easier to open them, when compared with one or more doors oriented in the horizontal plane, thus reducing the load on the fan when opening the doors.

Figure 5A:
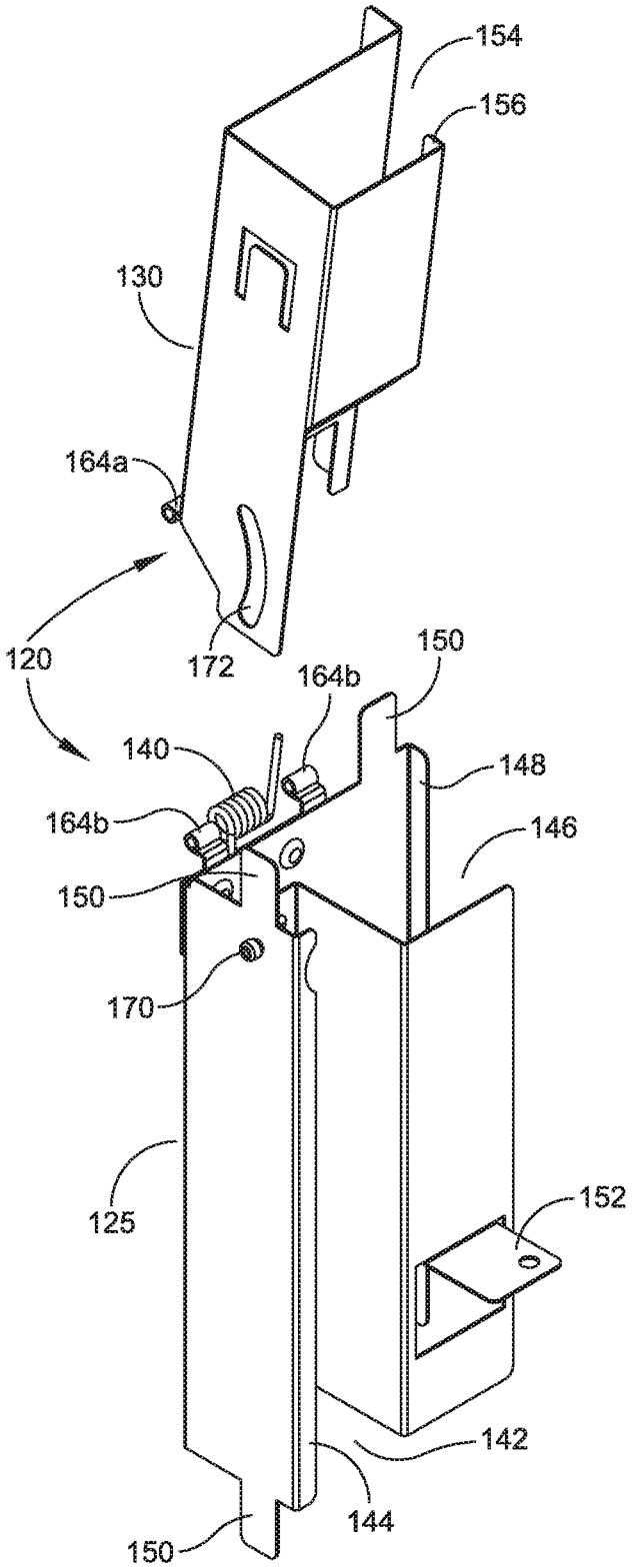
FIG. 5A illustrates the components of a hinged bracket for use with the insulated cover according to embodiments.
Figure 5B:
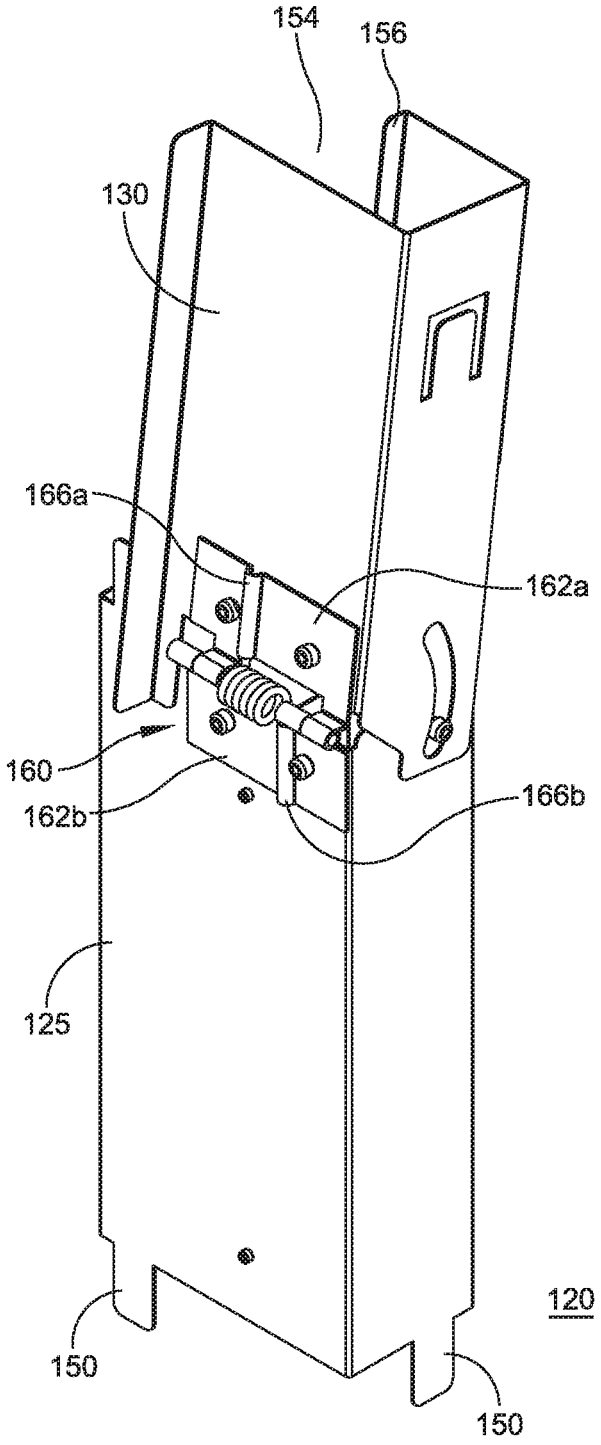
FIG. 5B illustrates an assembled hinged bracket according to embodiments.

FIGS. 5A and 5B illustrate a more detailed view of one of the four hinged brackets 120 that connect the ceiling doors 115*a*, 115*b* to the triangular shaped front and rear insulation board walls 105*a*, 105*b* and the rectangular side walls 110*a*, 110*b*. Specifically, FIG. 5A is a perspective view of the lower and upper bracket components 125, 130 before connection to one another, and FIG. 5B shows the lower and upper bracket components 125, 130 connected to one another but without the locking pin 135 securing those components together. Several features of these components are described below.

As can be seen in FIG. 5A, the lower bracket component 125 includes a channel 142 for receiving an end of the front or rear insulation board walls 105*a*, 105*b*. Those walls 105 may include a groove 141 (FIG. 2) in which protruding wall 144 sits in order to help secure the walls 105*a*, 105*b* in place. In addition to acting as a fastening means, these grooves 141 also serve to properly align the insulation board walls 105 with respect to the side walls 110 during assembly. The lower bracket component 125 can be slipped over the end of the wall 105 with the wall 144 inserted into the groove 141. The lower bracket component 125 also includes a channel 146 for receiving and end of a rectangular side wall 110*a*, 110*b*. The side wall 110 also has a groove (not shown) for mating with the protruding wall 148 so as to secure the wall 110 to the lower bracket component 125 and to properly align the wall 110 in the channel 146. The lower bracket component includes various tabs 150 that can be folded over to rest on the proximate insulation board after assembly in order to help secure the panels in the brackets 120. The lower bracket component 125 may also include a protruding plate 152 with a pre-drilled or pre-formed hole. This plate can sit on the house fan frame and allows for the cover 100 to be secured to the fan frame via screws or other fasteners.

Figure 6:
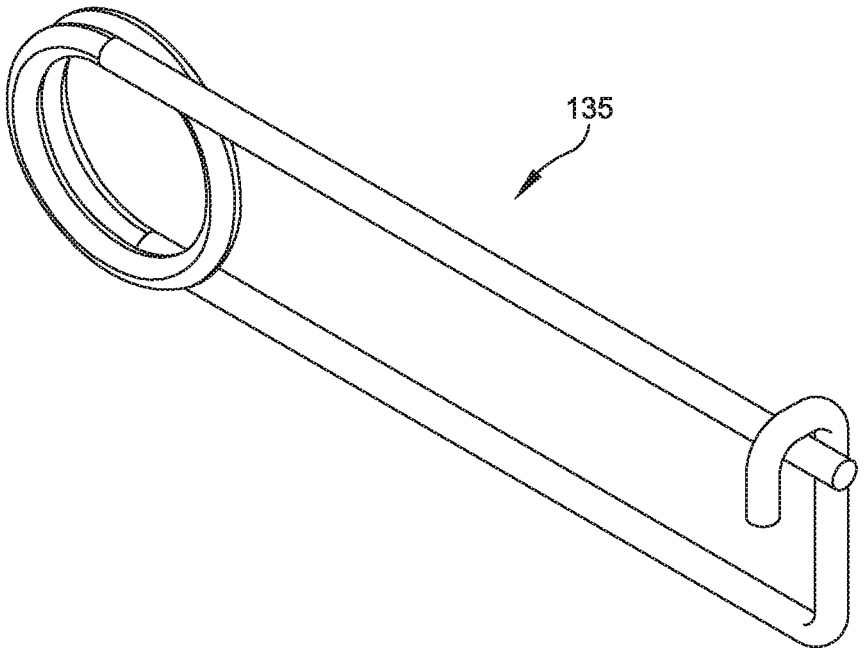
FIG. 6 is a perspective view of a locking pin for use in securing components of a hinged bracket according to embodiments.

Turning to the upper bracket component 130, this component includes a channel 154 for receiving an end of one of the left and right ceiling doors 115*a*, 115*b*. This channel 154 can also include a protruding wall 156 for insertion in a matching groove on the ceiling door 115 (not shown). During assembly, the locking pin 135 is inserted through the channel formed by the aligned knuckle components 164*a*, 164*b* and the center of the torsional spring 140. A more detailed view of an embodiment of the locking pin 135 is shown in FIG. 6.

Figure 7A:
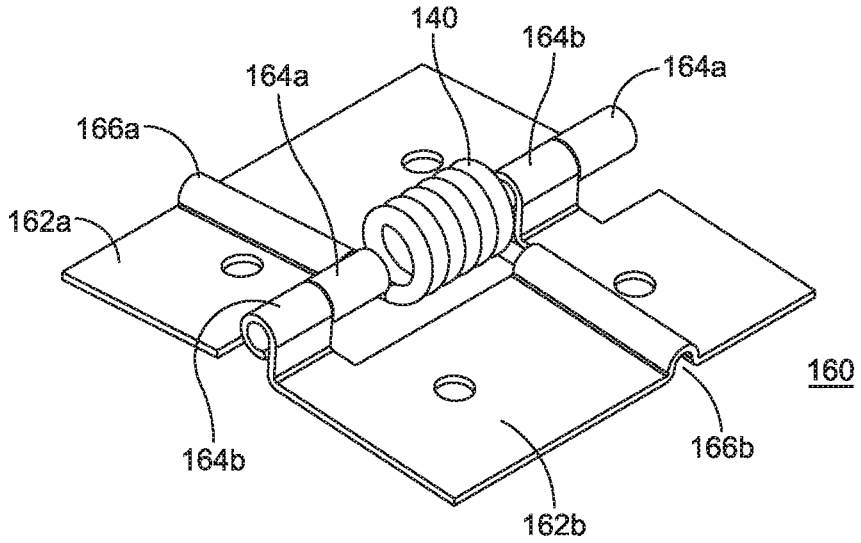
FIGS. 7A-7C illustrate a hinge for use with a hinged bracket according to embodiments.

Connected to the upper and lower bracket components 130, 125 is a hinge 160 having first leaf component 162*a* and cylindrical channel knuckle component 164*a* on the upper bracket component 130 and a second leaf component 162*b* and mating cylindrical channel knuckle component 164*b* on the lower bracket component 125. The upper and lower leaf components 162*b*, 162*a* also include channels 166*b*, 166*a*, respectively, for receiving the protruding ends of the torsional spring 140. An enlarged perspective view of the hinge 160 is shown in FIG. 7A. FIG. 6 is a perspective view of an embodiment of a locking pin 135 for use with the hinge 160.

In embodiments, the locking pin 135 is pre-assembled with the hinge 160 and, in embodiments, is not of the removable type.

Figure 7B:
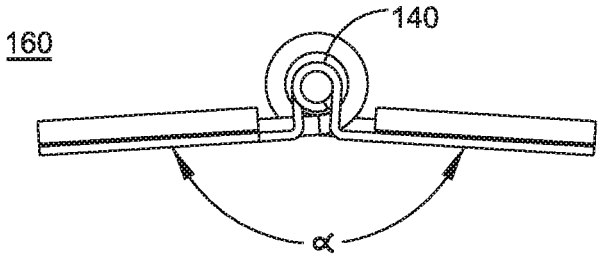
Figure 7C:
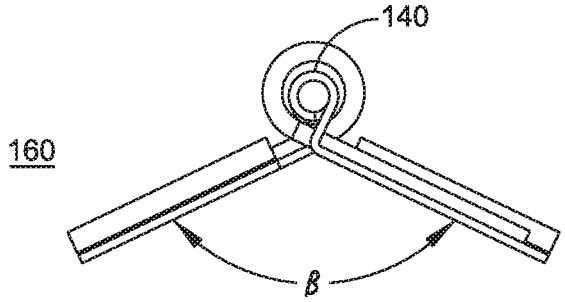
Figure 8:
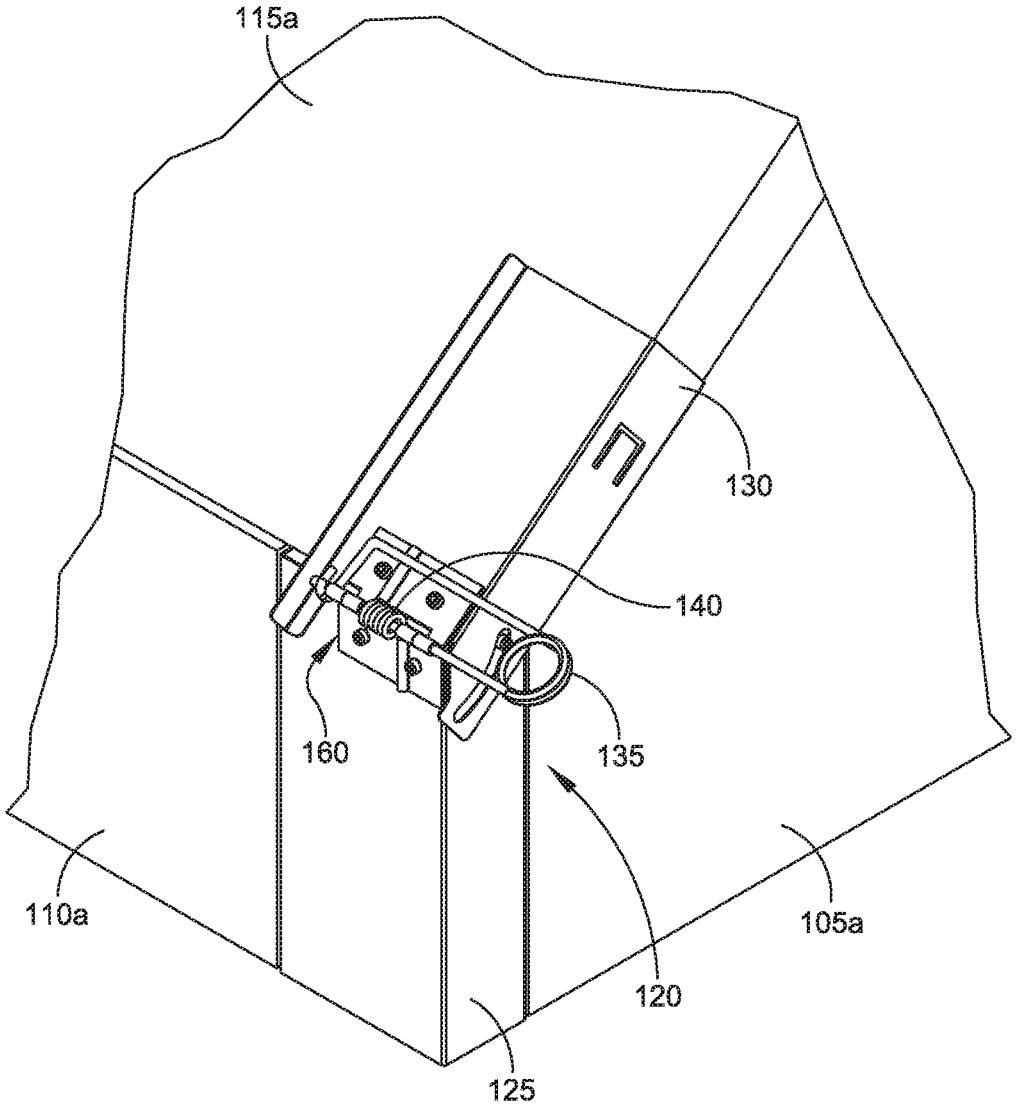
FIG. 8 is an enlarged partial perspective view showing the bracketed corner of the insulated cover.

FIG. 7B shows the hinge 160 in its neutral position, i.e., with the torsional spring 140 in its neutral resting state. In this position, the leaves 162*a*, 162*b* are angled with respect to one another at an angle α between about 170-190°, and in embodiments between about 170-180°, and in embodiments less than 180°, such as about 173°. FIG. 7C shows the hinge 160 with the torsional spring 140 in its fully extended position, i.e., when the ceiling door 115 to which the leaf 162*a* is attached is in the closed resting position when fan is off. In this position, the leaves 162*a*, 162*b* are at an angle β between about 126-132° with respect to one another, and in embodiments about 129°. FIG. 8 is an enlarged partial perspective view showing the bracketed corner of the insulated cover. Once the fan is disengaged, gravity and the weight of the ceiling doors 115 will work to close the ceiling doors 115 over the fan. The torsional spring 140 is configured such that once the fan is disengaged, the weight of the ceiling doors loads the spring, which works to try to hold the ceiling doors 115 open. The spring load is not enough to prevent the ceiling doors 115 from closing (i.e., the weight of the doors 115 overcomes the spring 140), but it does help ease the ceiling doors 115 down into their closed resting position (FIG. 3), which prevents or greatly reduces sound that would occur if the doors 115 were allowed to loosely flop into the closed position. In embodiments, the weight of the ceiling doors is close to net zero when factoring in the pull of the spring 140. That is, the weight of the doors 115 against the pull of the spring is such that the weight is just enough to close the ceiling doors 115 when the fan is disengaged but there is minimal force needed to open the doors 115. That is, the total torque of two springs is roughly equal to or proportional to the torque generated by the weight of a door 115 around the rotational axis. It should be understood that less torque (of the springs) is needed with lighter board materials. In embodiments, torsional springs 140 are not used.

Returning to FIGS. 5A and 5B, the lower bracket component includes a rivet 170 or other protrusion that sits and rides in an elliptical slot 172 within the upper bracket component 130. The rivet 170 and slot 172 are designed to cooperate to prevent the doors 115*a*, 115*b* from opening too far or overextending, i.e., extending beyond a point where gravity will work to close the doors 115*a*, 115*b* when the fan is disengaged. In embodiments, the ceiling doors 115 are restricted from opening beyond 90° from horizontal. In embodiments, when the doors 115 are fully open, these doors lean slightly inward. That is, in embodiments, the ceiling doors 115 are restricted from opening to 90° from the horizontal. In embodiments, this lean is between 1° to 7° from vertical (or 89° to 83° from horizontal).

In exemplary embodiments, the insulated cover 200 is sized to fit over 30" or 36" fans 10, though it should be understood that the insulated cover 200 can be sized as appropriate for other fan sizes. In embodiments, the insulated cover 200 is designed to meet or exceed California Title 24 energy efficiency standards, specifically the requirements set forth in Part 4 Section 502.11 of California's Title 24 Mechanical Code 2013 (whole house fans must have R-4.2+ cover that closes when the fan is off) and Section 110.7 (ceiling penetrations must limit exfiltration). In embodiments, the insulated cover 200 is designed to meet or exceed International Residential Code requirement R316.6, which currently requires certification to the requirements of NFPA 286 or protection by a thermal barrier. A thermal barrier could be a variety of materials, for example gypsum board or sheet metal of a minimum thickness. The cover 200 requires no tools for assembly and has no electrical requirements, i.e., the cover automatically opens and closes as the whole-house fan cycles. The innovative spring-hinge design reduces the "thumping" noise that occurs upon disengaging the device and also has the added benefit that it helps both doors open fully when the devices is engaged, which decreases static pressure. Further, providing the ceiling doors at an angled position when at rest and/or using a spring loaded hinge makes it easier to open those doors upon engagement of the fan, which reduces the load on the fan.

In embodiments, the boards from which the cover walls and doors are formed is a 1.5" thick polyisocyanurate rigid foam having an R-value of R9. It should be understood that the foam insulation board may be of the open or closed cell variety. Of course, it should be understood that other materials having other R-values may also be used. In exemplary embodiments, the boards have an R-value of at least 4, and more preferably at least 4.2. In exemplary embodiments, the interior and exterior of the boards are covered with a radiant barrier sheet, such as an aluminum radiant barrier. The radiant barrier sheet should be configured to reflect thermal radiation and, in embodiments, provide structural integrity to the panel. The barrier could also have vapor retardant or fire retardant properties as desirable. In embodiments, the boards are made from Rmax Thermasheath®-3 thermal insulation board available from Rmax Operating, LLC of Dallas Tex. This board is made from a closed-cell polyisocyanurate (polyiso) foam core bonded to reinforced aluminum foil facers on each side. In embodiments, the brackets are formed from 24 ga (0.024") galvanized (zinc plated) steel, though other materials, including plastics, may also be used as appropriate.

Figure 9:
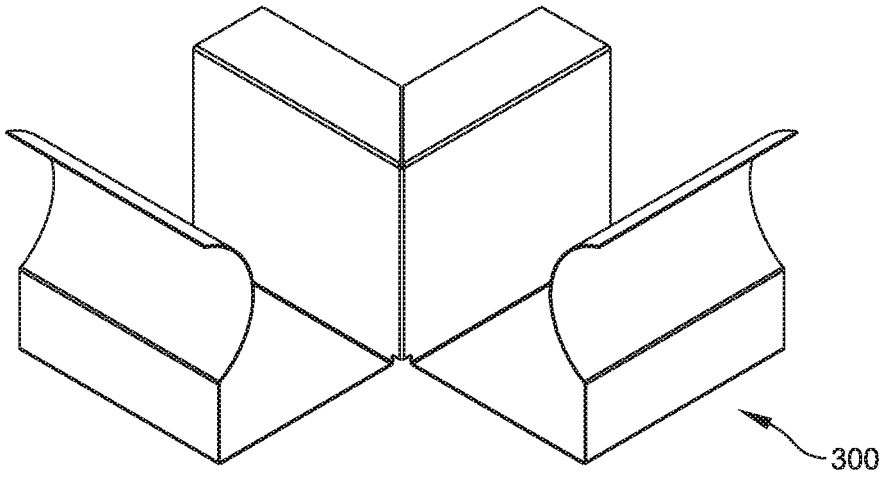
FIG. 9 is a perspective view of a lower non-hinged bottom bracket according to embodiments.
Figure 9A:
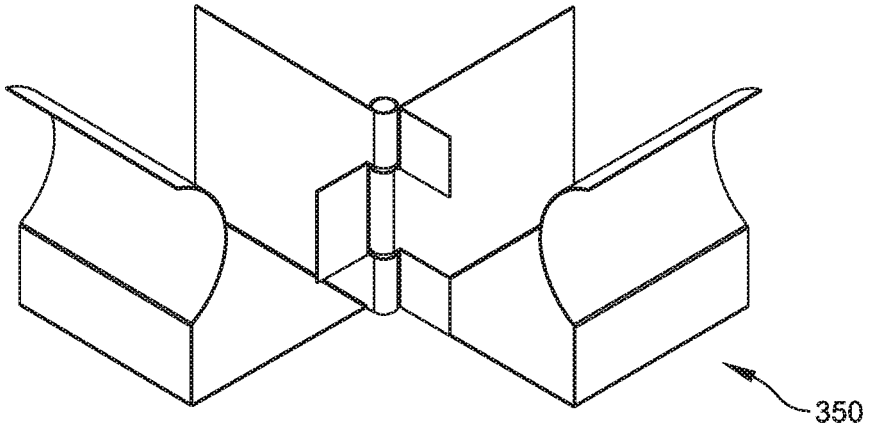
FIGS. 9A and 9B are perspective views of an upper hinged bracket according to embodiments.
Figure 9B:
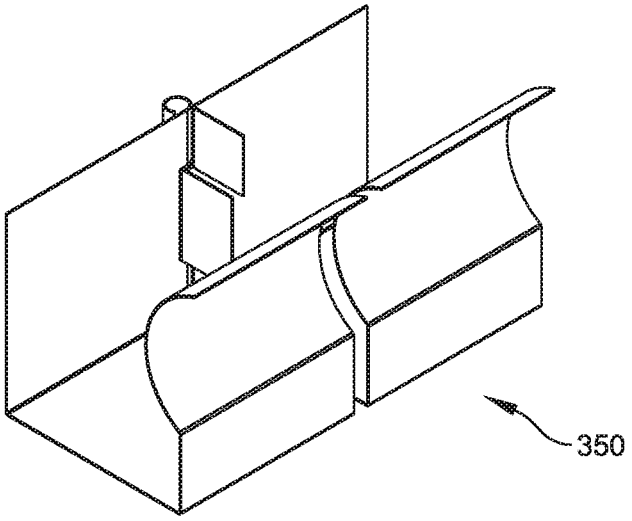

FIGS. 9 to 9B illustrate an embodiment of an alternative bracket system that can be used in assembling an insulated cover. FIG. 9 is a perspective view of a bottom bracket 300 that can used at each bottom corner of an insulated cover to connect a front or rear insulation board wall 105 with a rectangular side wall 110. An upper hinged bracket 350 is shown in FIGS. 9A and 9B. Four such upper hinged brackets 350 would be provided in a kit. This bracket is designed with two channels, one each for receiving an end of a door 115 and an end of rectangular side wall 110. The bracket is hinged to allow the door 115 to pivot with respect to the fixed side wall 110.

Described below is a method of assembling and installing an insulated cover for a whole-house fan, such as cover 200 described above. As noted above, the cover can be provided as a kit including in embodiments: (i) two bracketed side panels 110, (ii) two un-bracketed insulation board walls 105; (iii) two bracketed insulation board ceiling doors 115; (iv) four locking pins 135; (v) 4 torsional springs 140; and (vi) and an installation instruction sheet(s). No tools are required for installation of the cover.

First, the installation location should be inspected to ensure that the doors of the this produce will not be obstructed by the roof or other structural members.

Second, all pieces of the kits should be removed from any container (e.g., box) in which they are supplied.

Figure 10A:
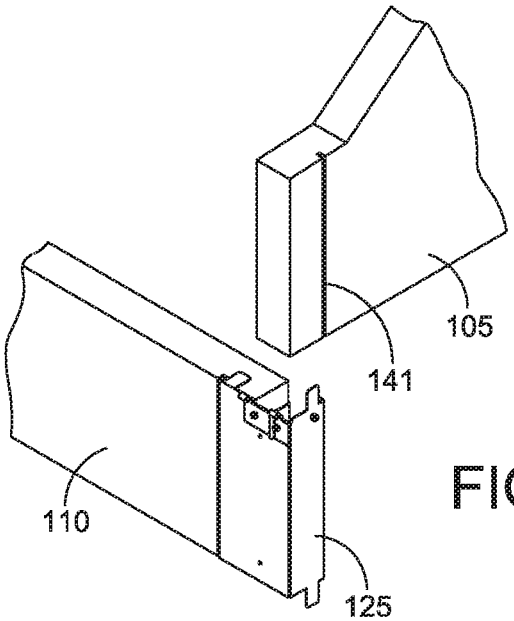
FIGS. 10A to 10D illustrate an assembly method for assembling an insulated cover from a kit according to embodiments.

Third, the four base pieces (i.e., the two bracketed side panels 110 and the two un-bracketed walls 105) are assembled in a square shape, i.e., with the side panels 110*a*, 110*b* opposite one another, the walls 105*a*, 105*b* opposite one another and the ends of the walls 105*a*, 105*b* disposed in the channels 142 of the lower bracket components 125. The panels that form walls 105 should slip snugly into the brackets 125, without tearing the panel facing. This step is illustrated in part in FIG. 10A. The grooves 141 in the un-bracketed panels 105 should face outward and mate with protruding wall 144 of lower bracket component 125 as described above.

Figure 10B:
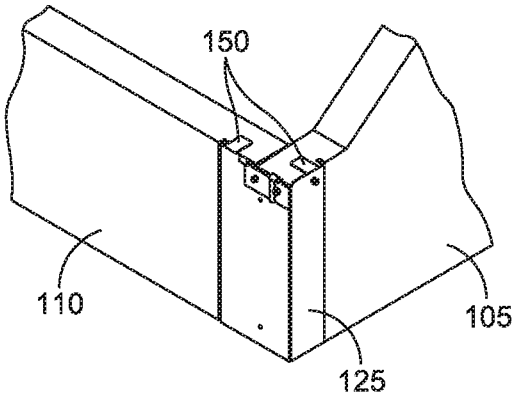

Fourth, any tabs 150 on the lower bracket components 125 are folded down to secure the un-bracketed panels 105 to the brackets, as shown in FIG. 10B. Optionally, tape can be applied to the opposite uncovered side of any groove 141 of a panel to provide reinforcement at the opposite side of the groove 141.

Figure 10D:
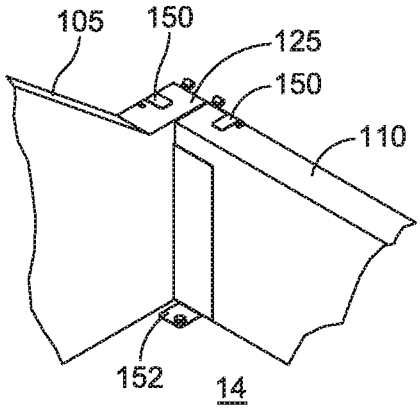
Figure 10C:
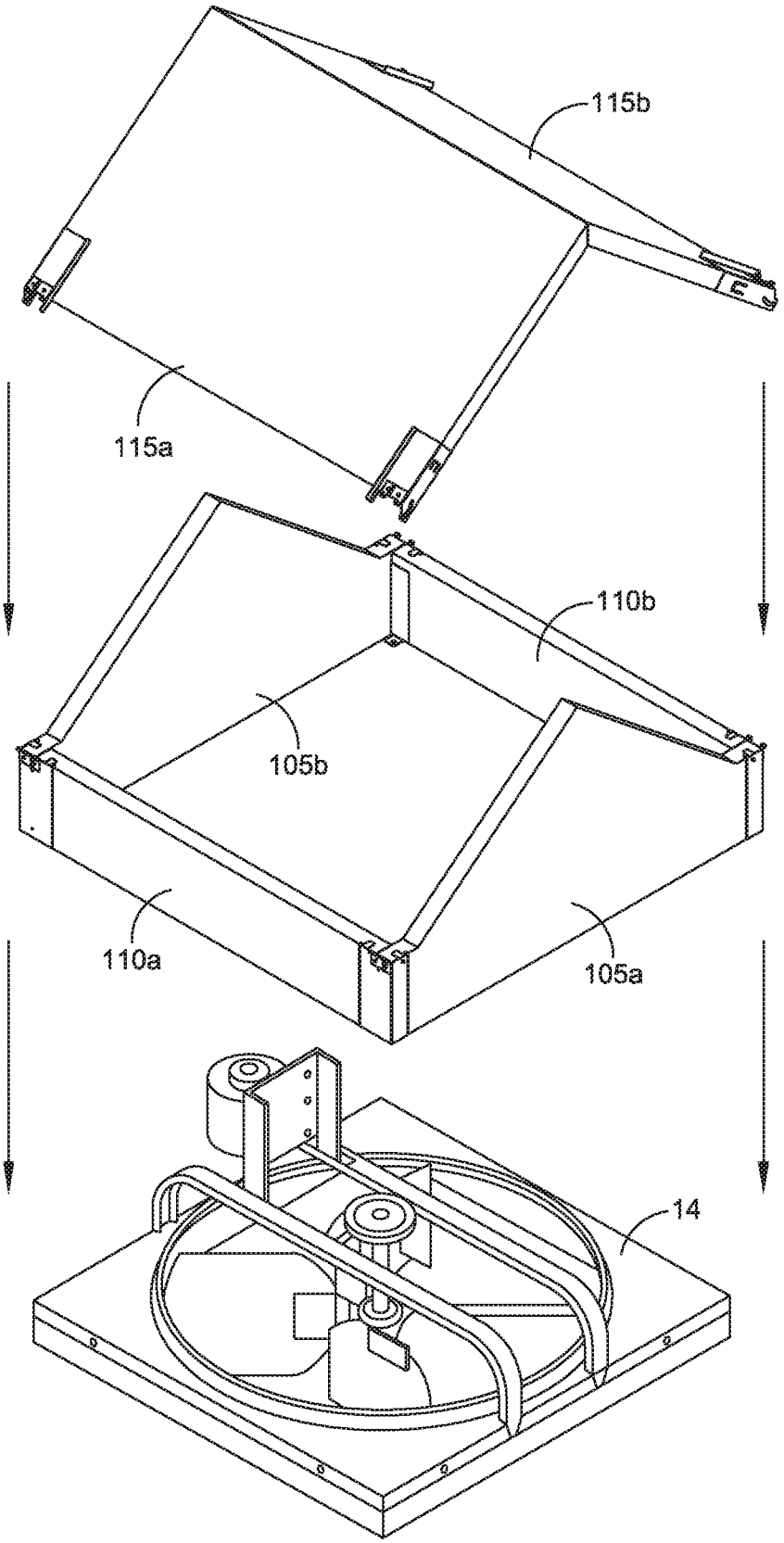

Fifth, taking hold of two opposite sides of the assembly, the assembly is placed onto the whole house fan, with one of the walls 105 on the same side of the fan as the fan motor, as shown in FIG. 10C.

Sixth, the assembly is optionally secured to the fan with four sheet metal screws through the protruding plates 152 of the brackets 125 into the top of the whole house fan, as shown in FIG. 10D.

Seventh, the doors 115 are connected to the assembly. Specifically, the upper bracket components 130 are connected to the reciprocal lower bracket components 125 to form brackets 120. To connect the upper and lower bracket components 130, 125, a locking pin 135 is used as described above. Prior to inserting the locking pins 135 in each hinge 160, the torsional springs 140 are installed. Specifically, the torsional spring legs are located in the hinge channels 166*a*, 166*b*. It should be verified that the locking pins 135 are functioning properly.

Eighth, the fan should be tested to ensure that the doors 115 have a full range of motion when forced open when the fan is operational.

Finally, any rips or tears in the insulation panels or significant gaps through which air might escape should be covered with aluminum tape, which is preferably UL 181A and B rated.

It should be understood that other assembly methods using glues, staples, nails, tacks or other fasteners may also be used depending on the selected design. In embodiments, any sizeable gaps between the bottom of the insulated cover and the whole-house fan can be sealed along the interior of the cover with UL rated aluminum tape.

As should be appreciated from the foregoing description, the insulated panels of the cover help seal the whole house fan opening to prevent heat from being transferred to/from the living space. The kit provides an easy retro-fit for previously installed whole house fans, allowing for these installations to become Title 24 compliant (by way of example). When R-9 closed cell foam panels are used, the cover more than doubles the minimum requirements of the Californian Title 24 insulation rating for whole house fans. The doors of the cover open and close on their own, opening on fan start up and closing effortlessly as the fan turns off. No electricity is required, making the installation maintenance free. And there is no significant additional load on the fan. That is, the angle of the ceiling doors (when at rest) and the torsional spring cooperate to ease the load on the fan when opening the doors and maintaining the doors in their open orientation. Moreover, there is no need to seal the attic fan during the winter months when it is not in use. The cover is easily assembled and installed without the need for any tools. Kits having components in multiple sizes can be made in order to accommodate fans of different sizes, e.g., 30" and 36" models.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. An insulated cover for a whole-house fan, comprising:

a base defining an opening for disposal over the whole-house fan; and first and second, oppositely disposed, ceiling doors each hingedly connected to the base, wherein in a closed configuration the ceiling doors each sit at an acute angle with respect to a horizontal plane corresponding with a bottom surface of the base, wherein the base and ceiling doors are formed from thermal insulation board, springs configured to assist the ceiling doors in opening when the whole-house fan is on and to provide resistance against the ceiling doors returning from an open configuration to the closed configuration when the whole-house fan is off, the resistance being insufficient to prevent the ceiling doors from returning to the closed configuration under load of the weight of the doors when the whole-house fan is off wherein the base is connected to the ceiling doors by hinged brackets.

2. The insulated cover of claim 1, wherein the thermal insulation board has an R-value of at least 4.2.

3. The insulated cover of claim 2, wherein the insulation board has a radiant barrier sheet disposed thereon and facing an interior of the insulated cover.

4. The insulated cover of claim 1, wherein the base comprises first and second side walls positioned opposite one another, and front and rear walls positioned opposite one another and connected to the first and second side walls, wherein the front and rear walls each have an upper surface having first and second sloped portions extending towards a center of the upper surface and on which the ceiling doors sit when in the closed configuration.

5. The insulated cover of claim 1, wherein the hinged brackets are configured to restrict the ceiling doors from opening beyond 90° from horizontal plane.

6. The insulated cover of claim 5, wherein the hinged brackets are configured to restrict the ceiling doors from opening to 90° from the horizontal plane.

7. The insulated cover of claim 1, wherein the springs are torsional springs and wherein each hinged bracket includes a respective torsional spring configured to assist the ceiling doors in opening when the whole-house fan is on and to provide resistance against the ceiling doors returning from the open configuration to the closed configuration when the whole-house fan is off.

8. The insulated cover of claim 1, wherein the hinged brackets comprise four hinged brackets each disposed at a respective corner of the cover, wherein the base comprises first and second side walls positioned opposite one another, and front and rear walls positioned opposite one another and connected to the first and second side walls, and wherein each hinged bracket includes a lower bracket component configured to connect one of the side walls with one of the front or rear walls, and an upper bracket component coupled to the lower bracket component by a hinge and to one of the ceiling doors.

9. The insulated cover of claim 8, wherein the springs are torsional springs and wherein each hinged bracket includes a respective torsional spring configured to assist the ceiling doors in opening when the whole-house fan turns on and to provide resistance against the ceiling doors transitioning from the open configuration to the closed configuration when the whole-house fan turns off.

10. The insulated cover of claim 8, wherein each hinged bracket includes a removable locking pin disposed within a knuckle of the hinge and coupling first and second leaf components of the hinge together.

11. A kit for use in assembling an insulated cover for a whole-house fan, comprising:

first and second thermal insulation board ceiling doors;

first and second thermal insulation board side walls;

front and rear thermal insulation board walls;

four lower hinged bracket components;

four upper hinged bracket components;

four locking pins for coupling the upper hinged bracket components to the lower hinged bracket components; and springs configured to, after assembly of the insulated cover, assist the ceiling doors in opening when the whole-house fan is on and to provide resistance against the ceiling doors returning from an open configuration to a closed configuration when the whole-house fan is off, the resistance being insufficient to prevent the ceiling doors from returning to the closed configuration under load of the weight of the doors when the whole-house fan is off.

12. The kit of claim 11, wherein the upper hinged bracket components are coupled to the ceiling doors and the lower hinged bracket components are coupled to either the first and second thermal insulation board side walls or the front and rear thermal insulation board walls.

13. The kit of claim 11, wherein the springs comprises four torsional springs.

14. The kit of claim 11, wherein the thermal insulation board ceiling doors, thermal insulation board side walls, and the front and rear thermal insulation board walls are formed from thermal insulation board having an R-value of at least 4.2.

15. The kit of claim 13, wherein the front and rear thermal insulation board walls each have an upper surface having first and second sloped portions extending to a center of the upper surface.

16. A method of insulating a whole-house fan, comprising the steps of:

providing an insulated cover, the insulated cover comprising:

a base defining an opening for disposal over the whole-house fan; and first and second ceiling doors each hingedly connected to the base, wherein in a closed configuration the ceiling doors each sit at an acute angle with respect to a horizontal plane corresponding with a bottom surface of the base, wherein the base and ceiling doors are formed from thermal insulation board; and disposing the insulated cover over the whole-house fan, whereby the ceiling doors are forced open from the closed configuration to an open configuration by air flow from the whole-house fan when the whole house fan turns on and return to the closed configuration to form an insulated cover around the whole-house fan when the whole-house fan turns off, wherein the insulated cover includes springs configured to assist the ceiling doors in opening when the whole-house fan is on and to provide resistance against the ceiling doors returning from the open configuration to the closed configuration when the whole-house fan is off, the resistance being insufficient to prevent the ceiling doors from returning to the closed configuration under load of the weight of the doors when the whole-house fan is off wherein the base is connected to the ceiling doors by hinged brackets.

17. The method of claim 16, wherein the thermal insulation board has an R-value of at least 4.2 and has a radiant barrier sheet disposed thereon and facing an interior of the insulated cover.

18. The method of claim 16, wherein the springs are torsional springs and wherein each hinged bracket includes a respective torsional spring configured to assist the ceiling doors in transitioning from the closed configuration to the open configuration when the whole-house fan is turned on and to provide the resistance against the ceiling doors moving from the open configuration to the closed configuration when the whole-house fan is turned off.

19. The insulated cover of claim 18, wherein the hinged brackets are configured to restrict the ceiling doors from opening to 90° from the horizontal plane.

20. The insulated cover for a whole-house fan of claim 1, wherein torque exerted by the springs is less than torque generated by the weight of the ceiling doors when moving from the open position to the closed position.

21. The insulated cover for a whole-house fan of claim 1, wherein the insulated cover is installed over a whole-house fan, the whole-house fan being installed in an attic of a structure over an opening in a ceiling to draw air into the attic from an occupied space of the structure.

22. The insulated cover for a whole-house fan of claim 21, wherein a motor of the whole-house fan is disposed on an attic-side of the whole-house fan.

* * * * *